United States Patent [19]

Delsack

[11] Patent Number: 5,038,644

[45] Date of Patent: Aug. 13, 1991

[54] FINGER WRENCH OR THE LIKE

[76] Inventor: Kurt Delsack, 25 Mainsail Dr., Corona del Mar, Calif. 92625

[21] Appl. No.: 140,081

[22] Filed: Dec. 31, 1987

Related U.S. Application Data

[63] Continuation-in-part of Ser. No. 70,713, Jul. 7, 1987.

[51] Int. Cl.[5] ..... B25B 23/16; B25B 13/12

[52] U.S. Cl. ..... 81/177.3; 81/353; 7/142; 7/165

[58] Field of Search ..... 81/177.3, 347, 352–355, 81/3.42, 423, 437, 439; 7/142, 138, 129, 125, 127, 165; 30/298, 291, 232, 113

[56] References Cited

U.S. PATENT DOCUMENTS

| | | | |
|---|---|---|---|
| 12,946 | 6/1907 | Tritschler . | |
| 715,315 | 12/1902 | Steinecke . | |
| 1,043,363 | 11/1912 | Schickerling . | |
| 1,269,593 | 6/1918 | Fuller . | |
| 2,594,363 | 4/1952 | Stephenson | 7/129 X |
| 2,647,424 | 8/1953 | Gordon . | |
| 2,669,894 | 2/1954 | Kassel . | |
| 2,725,774 | 12/1955 | Tekse | 30/92 X |
| 2,910,769 | 11/1959 | Schneider | 81/3.42 X |
| 3,858,258 | 1/1975 | Stevens | 7/165 X |
| 4,477,936 | 10/1984 | Weston | 7/165 X |

*Primary Examiner*—D. S. Meislin

*Attorney, Agent, or Firm*—Fleit, Jacobson, Cohn, Price, Holman & Stern

[57] ABSTRACT

A finger wrench or the like for threading and unthreading articles such as nuts or bolts has a pair of slidingly interfitted jaw members with respective finger openings and article gripping edges between the finger openings. In use, the gripping edges are opened out and fitted over an article to be manipulated so as to engage opposite surfaces of the article. Torque is applied through the finger openings. Increased leverage may thus be applied to the article compared with gripping it directly in the fingers, the increase in lever arm being represented by the distance from the respective gripping edges to the finger openings.

17 Claims, 2 Drawing Sheets

FINGER WRENCH OR THE LIKE

CROSS REFERENCE TO RELATED APPLICATION

This application is a Continuation-In-Part of application Ser. No. 07/070,713 filed July 7, 1987 and the contents of which is expressly incorporated herein by reference in its entirety.

BACKGROUND OF THE INVENTION

This invention relates to a hand-held tool which is primarily intended for use as a finger wrench or pliers for manipulating nuts, bolts and the like in tightening or loosening same, but which can also include mechanisms useful for other purposes, such as wire stripping or as a crimping tool.

When using the fingers to tighten or loosen a nut, bolt, or screw, if the fingers are applied directly around the head of the article, limited leverage is available dependent on the head diameter. The invention provides a compact pocket tool which can be used to increase the leverage available when tightening or loosening nuts by finger pressure.

The tool of the instant invention, as will be seen from the following detailed description, can be multi-purpose replacing ordinary tools which are larger and bulkier and substantially more expensive. The device described hereinafter is compact, lightweight and costs no more than pennies to manufacture. It will find uses in many areas by professionals to hobbyists to homeowners. It can be used for carpenter's jobs as a nut tightener and loosener and to position and hold nails in places which are otherwise difficult to reach. Plumbers will find the tool useful for tightening and loosening end caps and connectors, as a heat sink and as a holder for soldering. Electricians will be able to strip wires, crimp solderless connectors and other similar uses. The tool of this invention, because of its inexpensive nature can be included with knock-down furniture or other products requiring assembly by the end-user consumer. Commercial user such as telephone installers, electrical and electronic component repairers, and auto mechanics and the like will find a myraid of applications for a universal tool of this nature. The tool can include both Phillips head and conventional screwdrivers and other multipurpose elements.

SUMMARY OF THE INVENTION

In accordance with the invention, a tool for use in facilitating finger manipulation of a threaded article such as a nut, bolt or the like comprises a pair of slidingly interconnected substantially flat and coplanar jaw members, finger-engageable formations on the respective jaw members, such as finger openings in the respective jaw members, or depressions at the outer ends of the respective jaw members, and substantially coplanar substantially parallel gripping edges on the jaw members between the finger formations, the jaw members having a closed position in which the gripping edges are in substantial abutment, or closely spaced apart, and the jaw members being movable from the closed position progressively to increase the distance between the gripping edges and provide an opening into which the article can be fitted with the gripping edges embracing the article whereby torque may be applied to the article through the gripping edges, from said formations, the torque lever arm for each jaw member being half the cross dimension of the article plus the distance from the respective gripping edge to the respective finger formations.

Thus, greater leverage can be applied to the article than by simply gripping it in the fingers. Moreover, the size of the opening between the gripping edges can be varied substantially infinitely between the closed position and a position of maximum opening, which latter depends on the size of the device, so that different sized bolts, nuts and the like, can be accommodated.

The device may be formed from substantially identical jaw members which are mirror images of one another and which have integrally formed elongate male and female interfitting guides on which the jaw members slide mutually. The jaw members may be formed of a metal or a hard plastic, and the gripping edges may be serrated to enhance their grip. Further, the gripping edges may occupy only a central portion of the jaw members and may be extended angularly to provide for wire-stripping and/or crimping tool formations.

The device may include ratcheting-type teeth between the respective jaw members which provide greater resistance to opening than to closing of the jaw members so as to provide a vise-like action on an article being gripped allowing a user to release his or her grasp on the device while still retaining its grip on the article.

The device is distinguished, for example, from finger operated cigar-cutting devices in which a pair of finger-operated slides with guillotine-type cutting edges move across and over one another in adjacent planes to snip a cigar end with a shearing action in view of the substantial thickness of the substantially flat gripping edges.

Additional features and advantages of the invention will be apparent from the ensuing description and claims read in conjunction with the attached drawings.

DESCRIPTION OF PREFERRED EMBODIMENTS

Figure 1:
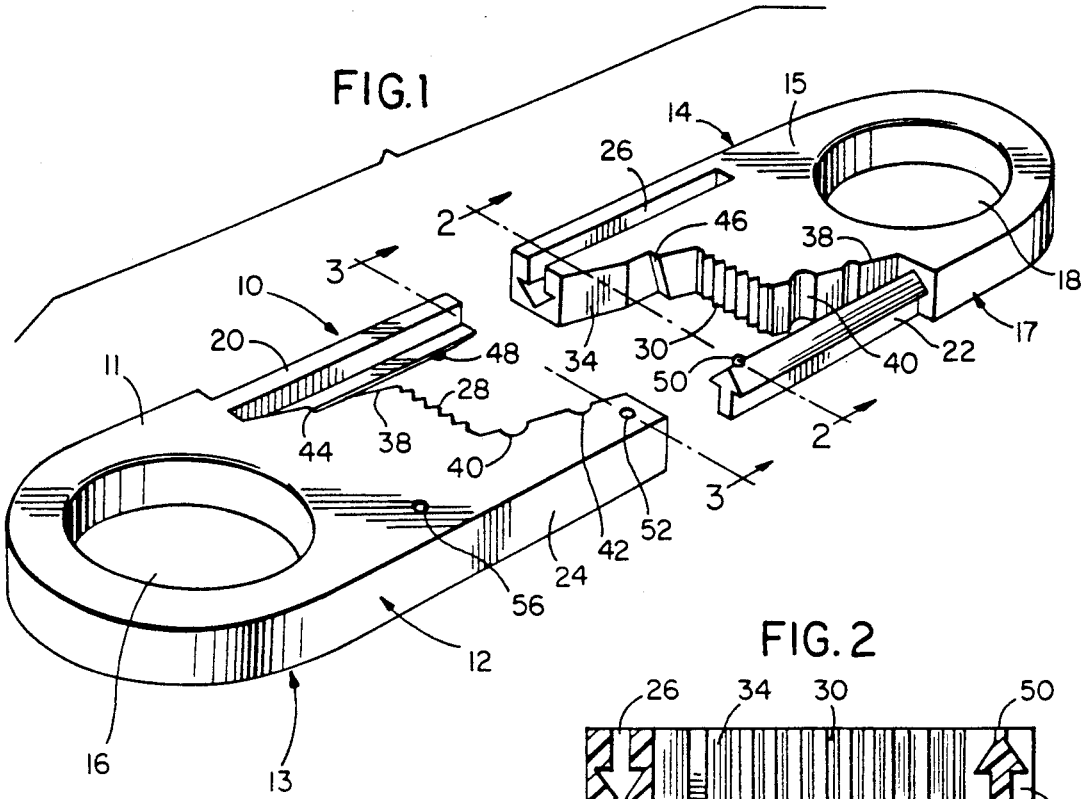
FIG. 1 is an exploded perspective view of a first embodiment device in accordance with the invention.
Figure 2:
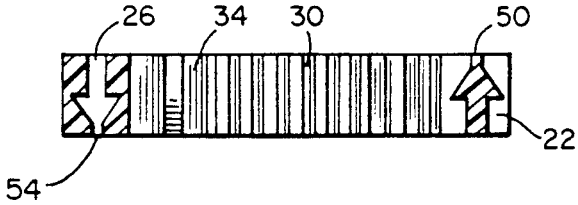
FIG. 2 is a sectional view on line 2—2 of FIG. 1.
Figure 3:
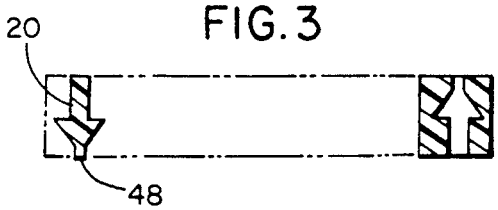
FIG. 3 is a sectional view on line 3—3 of FIG. 1.

The illustrated first embodiment device 10 shown in FIG. 1 to 4 comprises a pair of like jaw members 12, 14, which are mirror images of one another, and which in the illustrated embodiment are made of a hard plastic, although they could also be made of metal.

The gripping edges of the respective jaw members are of substantial thickness (e.g. about ¼ inch thick) and are substantially flat (except for the preferred serrations, which are optional). The jaw members have opposed flat face surfaces 11, 13, 15, 17 and are formed with respective finger openings 16, 18 adjacent their outer ends. Extending inwardly from the finger openings at opposite sides of the jaw members, are elongate male guide elements 20, 22 which have the shape of an arrow head or the like in cross-section and complimentary elongate female guide elements 24, 26 which receive the male guide elements, so as to assemble the device and allow the jaw members to slide mutually on one another in the same plane.

Figure 4:
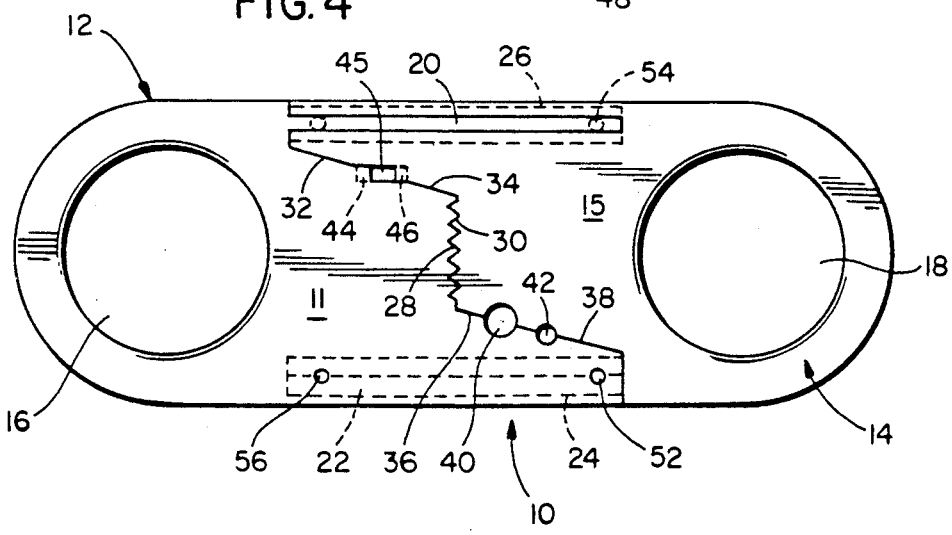
FIG. 4 is a plan view of the device in closed position.

Further, the jaw members may be formed at their confronting inner ends with parallel, serrated gripping edges 28, 30 which extend substantially perpendicularly to the face surfaces 11, 13, 15, 17, respectively at central portions of their inner ends, the gripping edges substantially abutting in the closed position of the device shown in FIG. 4, and with pairs of mating angled surfaces, 32, 34,36, 38 (see FIG. 4) extending from the gripping edges. Surfaces 36, 38 may be formed with recesses 40, 42 forming crimping tool openings to crush the edges, for example of a solderless connector, and surfaces 32, 34 may be formed with inclined edges 44, 46 forming a diamond opening 45 for use as a wire stripper in a conventional manner.

The device is assembled by fitting the respective male guide elements 20, 22 into the female guide elements 24, 26, and due to the symmetry of the jaw members, gripping edges 28, 30 will close on one another, or close at least to a position at which they are closely adjacent. From the closed position, the jaw members can be opened out with the fingers to progressively move the gripping edges apart. The male guide elements may be provided with nipples 48, 50 which snap into apertures 52, 54, in the female guide elements to inhibit separation of the jaw members. Another nipple-receiving opening 56 may be provided so that the jaws snap into the closed position. The overall length of the device, when closed, may be about 4 and a half inches, and its width about 1 and a half inches so as to readily fit in a pocket. The maximum jaw opening may be about 1 and a half inches, although other size tools could be produced without departing from the instant inventive concepts.

In use, the device may be opened out to the extent necessary for the opening between the gripping edges to fit over an article such as a bolt, nut or the like which is to be threaded or unthreaded (up to for example, one and half inch cross dimension) and the gripping edges engaged against opposite surfaces of the article. The device is manipulated with the thumb in one of the finger opening and the forefinger or middle finger in the other finger opening. It is understood that an increased torque arm for each finger is provided compared with simply gripping the bolt or nut in the fingers, the increase in the torque arm being represented by the distance between the respective gripping edge 28 or 30 and the respective opening 16 or 18. Therefore, increased torque can be applied to the bolt or nut.

The wire stripping and crimping tool formations may be used in known manner and are not required, although they make the device useful for other purposes.

Figure 5:
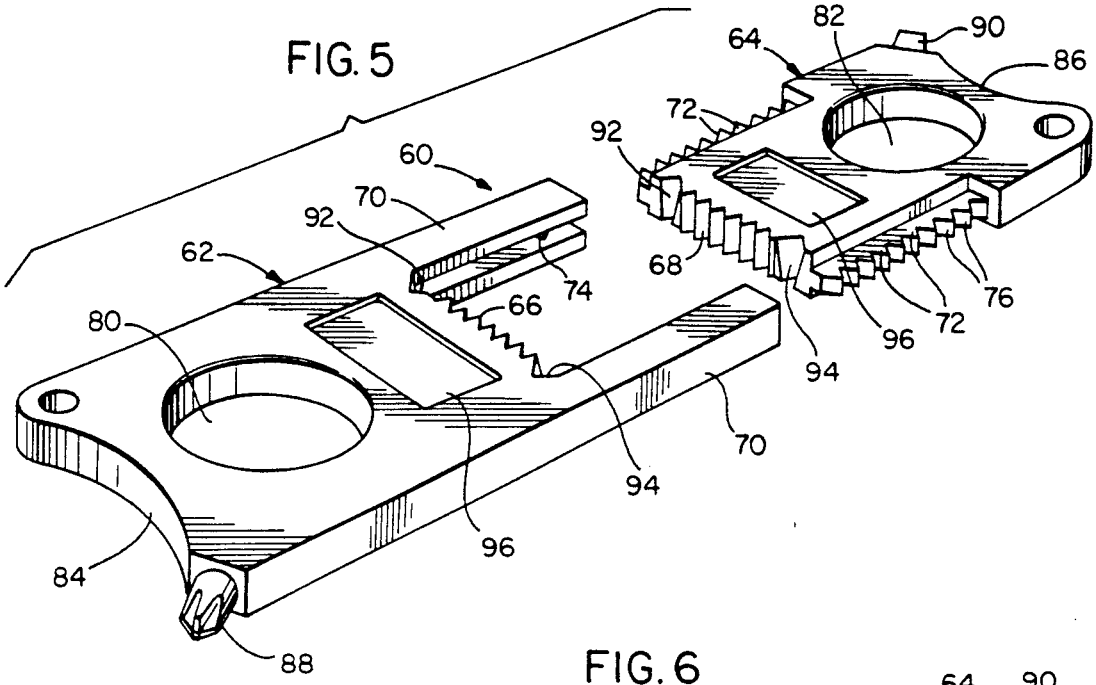
FIG. 5 is an exploded perspective view of a second-embodiment/ device in accordance with the invention.
Figure 6:
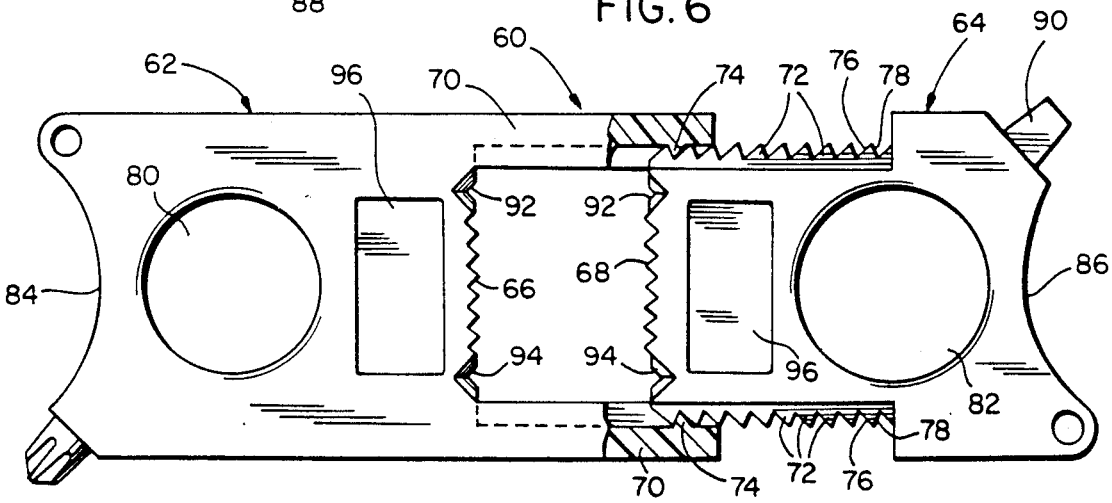
FIG. 6 is a plan view of the second embodiment device in open position.
Figure 7:
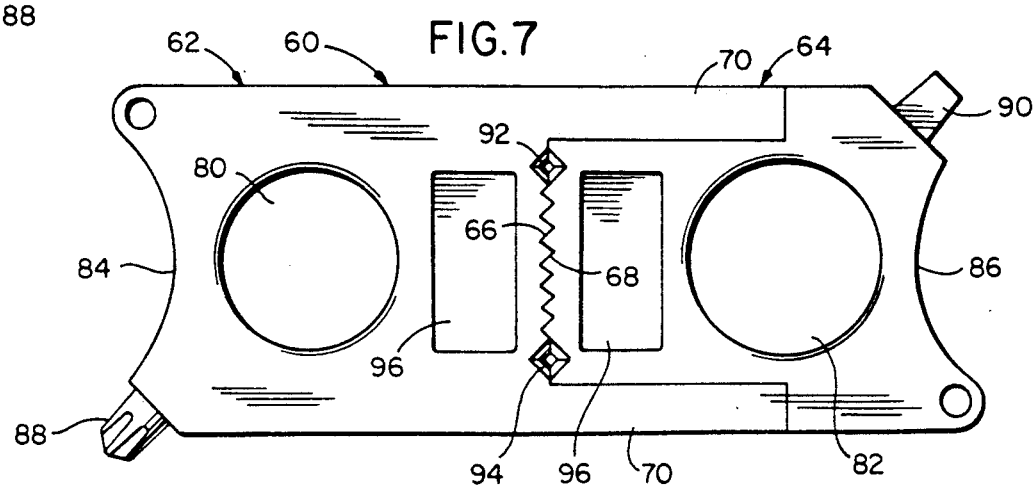
FIG. 7 is a plan view of the second embodiment device in closed position.

The second embodiment device 60 in accordance with the invention, which is illustrated in FIGS. 5 to 7 is generally similar in concept, structure, and use to the first embodiment device, insofar as it includes respective jaw members 62, 64 with serrated gripping jaws 66, 68 which can be opened and closed on one another, as previously.

In the second embodiment, however, jaw member 62 has a pair of partially elongate female guideway elements 70 and jaw member 64 slides in and out within the guideways. Opposite edges of jaw member 64 are formed with ratchet-type teeth 72, and each guideway 70 has at least on internal tooth 74 complimentary to the teeth 72 so as the engage therewith. Also, teeth 72 are each formed with one surface 76 which has a shallower incline that the opposite surface 78. This provides less resistance to the closing the jaw members on one another than to opening the jaw members so that a ratcheting and vise-type action of the jaws is provided allowing, for example, the jaws to be closed on an article and to retain its grip thereon even if released by a user. Also, the jaw members can be completely pulled apart and placed around an article, such as a nut on a pipe or the like, rather the over an article. Although the size of the teeth can be varied as necessary, in practice substantially smaller teeth have been found particularly useful and the drawings exaggerate the size of the teeth for illustrative clarity. It is evident that the guideway elements 70 should be sufficiently flexible to allow the ratcheting action of the teeth without allowing the device to release when torque is applied to clamp an article.

The jaw members 62, 64 are provided with finger openings 80, 82 as in the first embodiment one of which may be slightly larger than the other to promote insertion of a user's thumb. Further finger-engageable formations in the form of depressions 84, 86 are provided on the outer edges of the jaw members to allow increased torque to be applied.

Opposite corners Of the respective members may be provided with different tools, such as a cross-head screw driver head 88, and a conventional screw driver head 90. Different size wire stripping formations 92, 94 may also be provided as may shallow depressions 96 for advertising decals/embossed logos or the like.

While only preferred embodiments of the invention have been described herein in detail, the invention is not limited thereby and modifications may be made within the scope of the attached claims.

What is claimed is:

1. A finger wrench for use in threading and unthreading articles such as bolts, nuts and the like, comprising a pair of slidingly interconnected substantially flat and coplanar jaw members each having opposed substantially flat face surfaces, finger-engageable formations on the respective jaw members, and a gripping edge on each jaw member, said gripping edges being substantially perpendicular to said face surfaces and being located between the finger-engageable formations, the jaw members having a closed position in which the gripping edges are closely adjacent one another, the jaw members being movable from the closed position progressively to increase the distance between the gripping edges and provide an opening into which an article to be manipulated can be fitted, with the gripping edges engaging opposite surfaces of the article for the application of torque thereto by finger pressure applied to said formations.

2. The invention of claim 1 wherein the gripping edges are serrated.

3. The invention of claim 1 wherein the finger formations include finger openings in the respective jaw members.

4. The invention of claim 3 wherein one of the finger openings is larger that the other finger opening.

5. The invention of claim 3 wherein the finger formations further include depressions in respective outer edges of the jaw members.

6. The invention as defined in claim 1 wherein the gripping edges are about ¼ inch thick.

7. The invention as defined in claim 6 wherein the jaw members are made of a hard plastic.

8. The invention of claim 1 including respective work tools on opposite corners of the respective jaw members.

9. The invention of claim 1 including wire-stripping formations at least at one end of the respective gripping edges.

10. The invention of claim 1 wherein the gripping edges form central portions of respective inner ends of the jaw members, and said inner ends have angled portions on opposite sides of the gripping edges.

11. A finger wrench for use in threading and unthreading articles such as bolts, nuts and the like, comprising a pair of slidingly interconnected substantially flat and coplanar jaw members each having opposed substantially flat face surfaces, finger-engageable formations on the respective jaw members, and a gripping edge on each jaw member, said gripping edges being substantially perpendicular to said to said face surfaces and being located between the finger-engageable formations, the jaw members having a closed position in which the gripping edges are closely adjacent one another, the jaw members being movable from the closed position progressively to increase the distance between the gripping edges and provide an opening into which an article to be manipulated can be fitted, with the gripping edges engaging opposite surfaces of the article for the application of torque thereto by finger pressure applied to said formations and including cooperable ratchet-type teeth means on the respective jaw members for providing less resistance to closing the jaw members than to opening the jaw members.

12. The invention of claim 11 wherein one of the jaw members includes extended elongate female guideways in which opposite edge portions of the other jaw member can slide, and wherein the ratchet-type teeth are formed on said opposite edge portions and in the guideways respectively.

13. A finger wrench for use in threading and unthreading articles such as bolts, nuts and the like, comprising a pair of slidingly interconnected substantially flat and coplanar jaw members each having opposed substantially flat face surfaces, finger-engageable formations on the respective jaw members, and a gripping edge on each jaw member, said gripping edges being substantially perpendicular to said face surfaces and being located between finger-engageable formations, the jaw members having a closed position in which the gripping edges are closely adjacent one another, the jaw members being movable from the closed position progressively to increase the distance between the gripping edges and provide an opening into which an article to be manipulated can be fitted, with the gripping edges engaging opposite surfaces of the article for the application of torque thereto by finger pressure applied to said formations wherein the jaw members are formed with substantially coplanar interfitting male and female guide elements on which the jaw members slide mutually between closed and opened positions.

14. The invention as defined in claim 13 including detent means and detent receiving means associated with the guide elements which, in combination, provide a stop inhibiting separation of the jaw members.

15. The invention as defined in claim 13 wherein the jaw members are mirror images of one another, each jaw member having one of the male guide elements and one of the female guide elements.

16. The invention as defined in claim 13 wherein the guide elements comprise extended elongate female guideways on one of the jaw members and opposite edge portions on the other jaw member which slide in the guideways.

17. The invention as defined in claim 16 including cooperable ratchet teeth in said guideways and on said opposite edge portions respectively.

* * * * *